US010953525B2

(12) United States Patent
Hsu et al.

(10) Patent No.: US 10,953,525 B2
(45) Date of Patent: Mar. 23, 2021

(54) POWER WRENCH

(71) Applicant: Techway Industrial Co., Ltd., Taichung (TW)

(72) Inventors: Chih-Hua Hsu, Taichung (TW); Chen-Chen Cheng, Taichung (TW); Ying-Chih Wang, Taichung (TW)

(73) Assignee: Techway Industrial Co., Ltd., Taichung (TW)

( * ) Notice: Subject to any disclaimer, the term of this patent is extended or adjusted under 35 U.S.C. 154(b) by 282 days.

(21) Appl. No.: 16/140,647

(22) Filed: Sep. 25, 2018

(65) Prior Publication Data

US 2019/0351534 A1 Nov. 21, 2019

(30) Foreign Application Priority Data

May 21, 2018 (TW) ..... 10711717.6

(51) Int. Cl.
*B25B 21/02* (2006.01)
*B25B 21/00* (2006.01)

(52) U.S. Cl.
CPC ..... *B25B 21/02* (2013.01); *B25B 21/004* (2013.01)

(58) Field of Classification Search
CPC ..... B25B 21/02; B25B 21/023; B25B 21/026; B25B 21/004; B25B 21/005; B25B 21/007; B25B 13/48; B25B 13/481; B25B 13/5091; B25B 17/00; B25B 21/00; B25B 21/002; B25B 23/0078; E21B 19/16; B25F 5/02
See application file for complete search history.

(56) References Cited

U.S. PATENT DOCUMENTS

| | | | | |
|---|---|---|---|---|
| 429,034 | A * | 5/1890 | Justice | B25B 13/463 81/62 |
| 3,373,637 | A | 3/1968 | Behnke | |
| 8,752,455 | B1 * | 6/2014 | Taylor, Jr. | B25B 13/06 81/185 |
| 9,205,542 | B2 * | 12/2015 | Dedrickson | B25B 21/004 |
| 9,592,600 | B2 * | 3/2017 | Seith | B25F 5/02 |
| 9,950,411 | B1 * | 4/2018 | Clover | B25B 13/481 |
| 2010/0263492 | A1 | 10/2010 | Mah et al. | |
| 2012/0279362 | A1 * | 11/2012 | Cummings | B25B 13/56 81/57.11 |
| 2014/0182420 | A1 * | 7/2014 | Chen | B25B 13/463 81/57.13 |

FOREIGN PATENT DOCUMENTS

FR 2665389 A1 2/1992

OTHER PUBLICATIONS

Office Action issued to German counterpart application No. 102018216799.0 by the GPTO dated Jun. 5, 2019.
Office Action issued to German counterpart application No. 102018216799.0 by the GPTO dated Dec. 10, 2019.

* cited by examiner

*Primary Examiner* — Robert J Scruggs
(74) *Attorney, Agent, or Firm* — Burris Law, PLLC

(57) ABSTRACT

A power wrench includes an output spindle and a socket member. The output spindle has an axial through hole that extends through the output spindle and that open at two axially opposite ends of the output spindle. The socket member is connected to one of the axially opposite ends and has a first socket hole aligned with the axial through hole and configured to engage a nut or the like. The axial through hole is configured to permit passage of a bolt when the nut is tightened by the socket member.

9 Claims, 9 Drawing Sheets

POWER WRENCH

CROSS-REFERENCE TO RELATED APPLICATION

This application claims priority of Taiwanese Patent Application No. 107117176, filed on May 21, 2018.

FIELD

The disclosure relates to a wrench, and more particularly to a power wrench.

BACKGROUND

Generally, a fastener unitarily formed as one piece has a shank portion and a head portion disposed on an end of the shank portion. A conventional power wrench is usable to sleeve onto the head portion of the fastener in order to tighten or loosen the fastener during assembly/disassembly of an apparatus. U.S. Pat. No. 9,592,600 discloses a power wrench that has a blind hole with a single opening, through which the power wrench can engage the head portion of the fastener. Fasteners have existed in various forms. A fastening nut is usually used in combination with a bolt to fasten an object. When the fastening nut is sleeved onto the bolt attached to the object and is rotated until the fastening nut abuts the object, the fastening nut is tightened to the object. The power wrench disclosed in U.S. Pat. No. 9,592,600 is also suitable to rotate and tighten the fastening nut. However, if the bolt is too long, the bolt can abut a closed end of the blind hole and the fastening nut cannot be continuously rotated until it is tightened to the object. A manual operation has to be performed to complete the process of tightening the fastening nut, thereby consuming time and labor.

SUMMARY

Therefore, an object of the disclosure is to provide a power wrench that can alleviate the drawback of the prior art.

According to the disclosure, a power wrench includes a motor, a drive unit, an output unit and a housing unit.

The motor has a motor shaft.

The drive unit is connected to the motor and includes a gear set driven by the motor shaft.

The output unit is connected to the gear set, and includes an output spindle and a first socket member.

The output spindle is driven by the gear set and is rotatable about a rotation axis transverse to the motor shaft. The output spindle has an axial through hole that extends through the output spindle and that open at two axially opposite ends of the output spindle. The axial through hole is configured to permit passage of a bolt.

The first socket member is connected to the output spindle at one of the two axially opposite ends. The first socket member has a first socket hole aligned with the axial through hole and configured to engage a nut, a screw head, or the like.

The housing unit covers the motor, the drive unit and the output unit, and has two opposite openings which open outwards of the power wrench and each of which is aligned with the first socket hole and the axial through hole of the output spindle to provide a passage extending through the first socket hole and the axial through hole and between the opposite housing openings.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
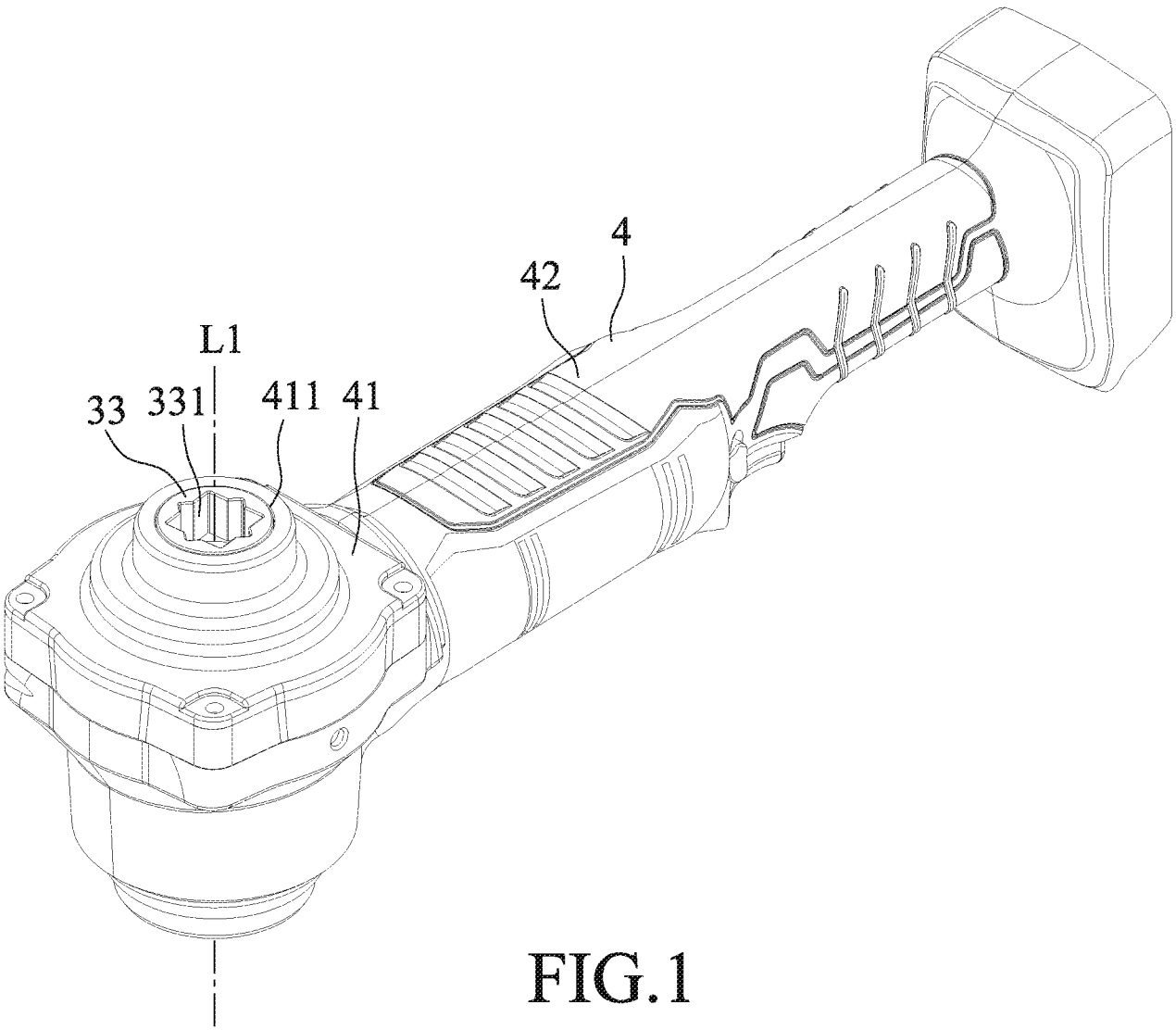
FIG. 1 is a perspective view illustrating a first embodiment of a power wrench according to the disclosure.
Figure 2:
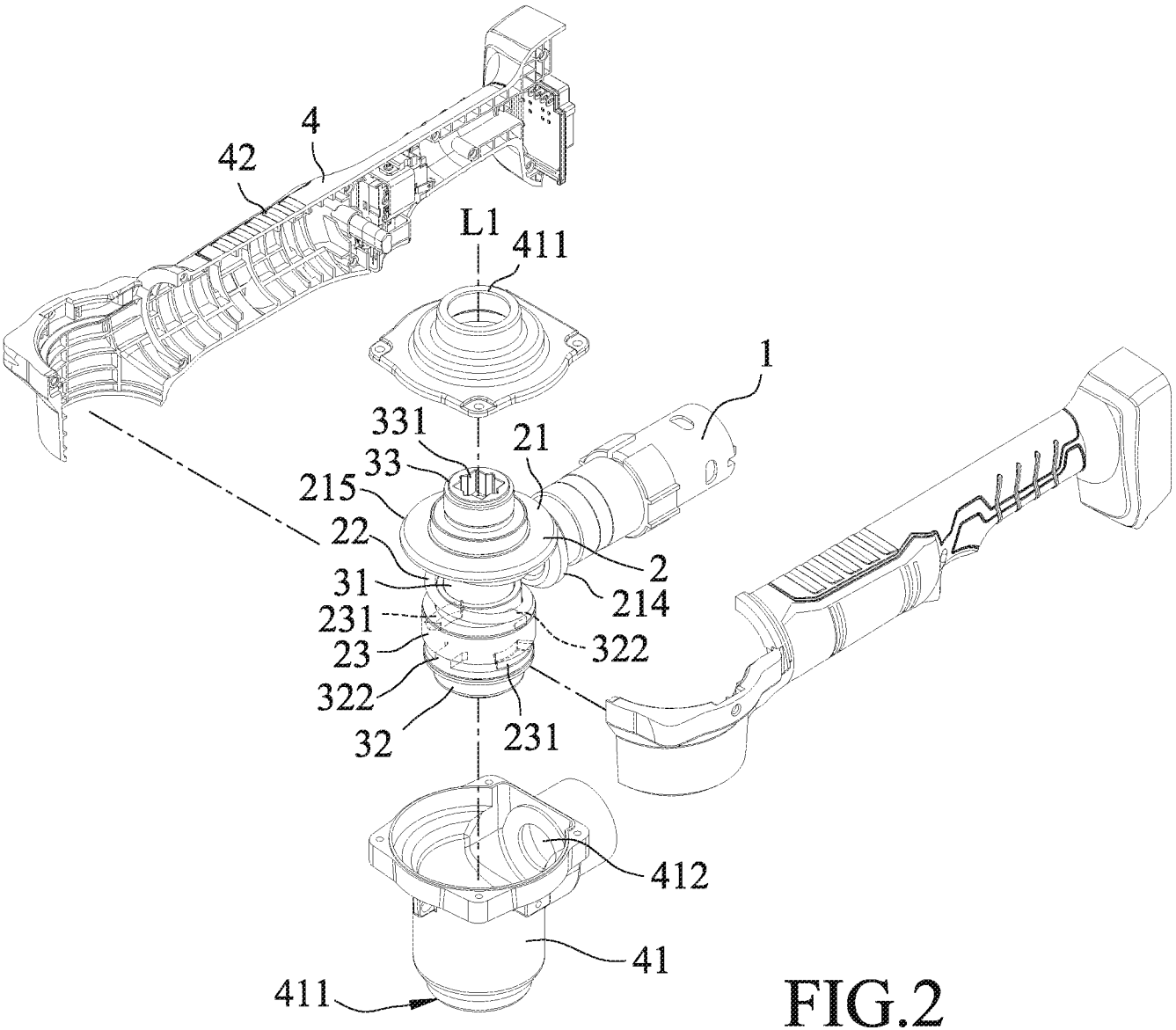
FIG. 2 is a partly exploded perspective view of the first embodiment.
Figure 3:
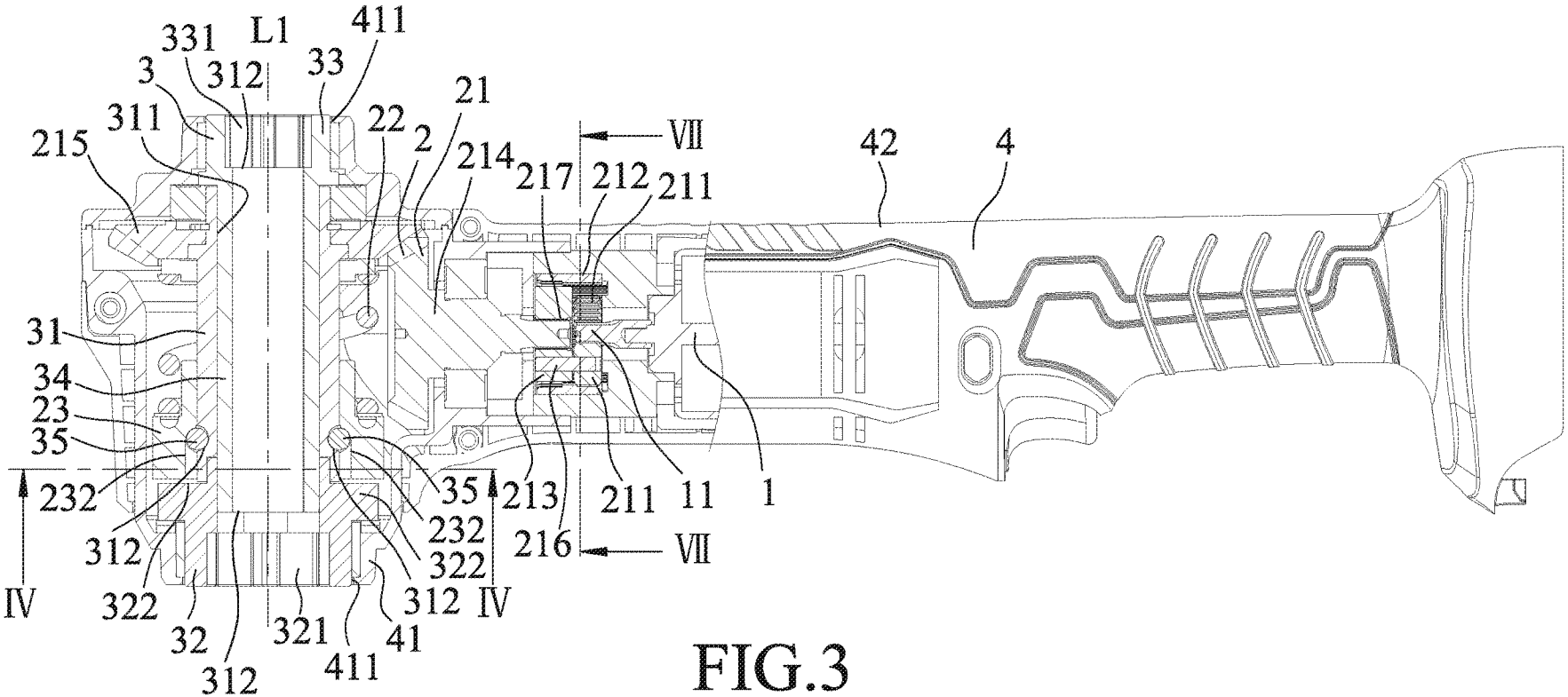
FIG. 3 is a sectional view of the first embodiment.

Before the disclosure is described in greater detail, it should be noted that where considered appropriate, reference numerals or terminal portions of reference numerals have been repeated among the figures to indicate corresponding or analogous elements, which may optionally have similar characteristics.

FIGS. 1 to 7 show a first embodiment of a power wrench according to the disclosure. The power wrench of the disclosure includes a motor 1, a drive unit 2, an output unit 3 and a housing unit 4, and is suitable for tightening and loosening fasteners, such as nuts, screw heads, and the like.

The motor 1 has a motor shaft 11.

The drive unit 2 is connected to the motor 1, and includes a gear set 21 driven by the motor shaft 11, a spring 22 connected to the gear set 21, and a flywheel 23 connected to the spring 22. The gear set 21 has a sun gear 210 mounted to the motor shaft 11, a carrier 213, three planetary gears 211 meshed with the sun gear 210 and mounted to the carrier 213, a ring gear 212 surrounding and meshed with the planetary gears 211, a first bevel gear 214 connected to the carrier 213, and a second bevel gear 215 meshed with the first bevel gear 214. In this embodiment, the ring gear 212 is positioned to the housing unit 4. The carrier 213 has three mounting shafts 216 for respectively mounting the planetary gears 211, and an engagement hole 217 engaged with the first bevel gear 214. The carrier 213 is concomitantly rotatable with the planetary gears 211. The first bevel gear 214 is concomitantly rotatable with the carrier 213. The spring 22 is connected to the second bevel gear 215.

The output unit 3 is connected to the gear set 21, and includes an output spindle 31, a first socket member 32, a tubular connection member 34 and a second socket member 33.

In this embodiment, the second bevel gear 215 is hollow and is sleeved on the output spindle 31. The output spindle 31 is driven by the second bevel gear 15 to rotate concomitantly with the second bevel gear 15 about a rotation axis (L1) transverse to the motor shaft 11. The output spindle 31 has an axial through hole 311 that extends through the output spindle 31 and that open at two axially opposite ends of the output spindle 31.

The first socket member 32 is connected to the output spindle 31 at one of the two axially opposite ends of the output spindle 31, such as by frictionally fitting one end of the first socket member 32 into the output spindle 31. The first socket member 32 has a first socket hole 321 aligned with the axial through hole 311 and configured to engage a nut, a screw head, or the like. The axial through hole 311 is configured to permit passage of a bolt.

The flywheel 23 is sleeved on the output spindle 31, and has a plurality of drive projections 231 axially projecting toward said first socket member 32. The first socket member 32 further has a plurality of radial projections 322 engageable with the drive projections 231. The flywheel 23 is concomitantly rotatable with the output spindle 31 because an inner surface of the flywheel 23 is interengaged with an outer surface of the output spindle 31 through engaging balls 35 movably received in grooves 312 formed in the output spindle 31 and grooves 232 formed in the flywheel 23. Because such an engagement arrangement is known, it is not detailed herein.

Figure 4:
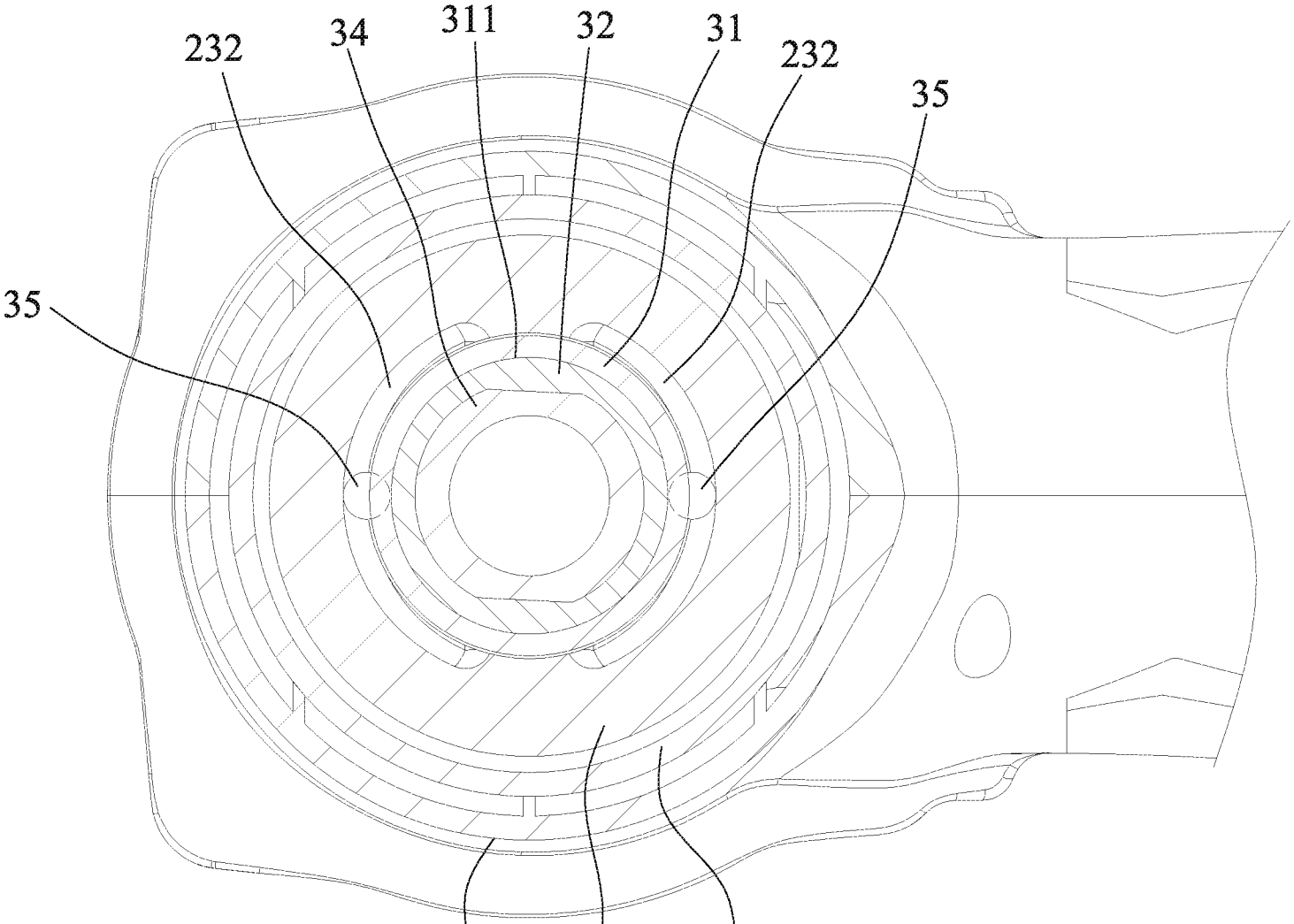
FIG. 4 is a fragmentary bottom sectional view of the first embodiment taken along line IV-IV of FIG. 3.
Figure 6:
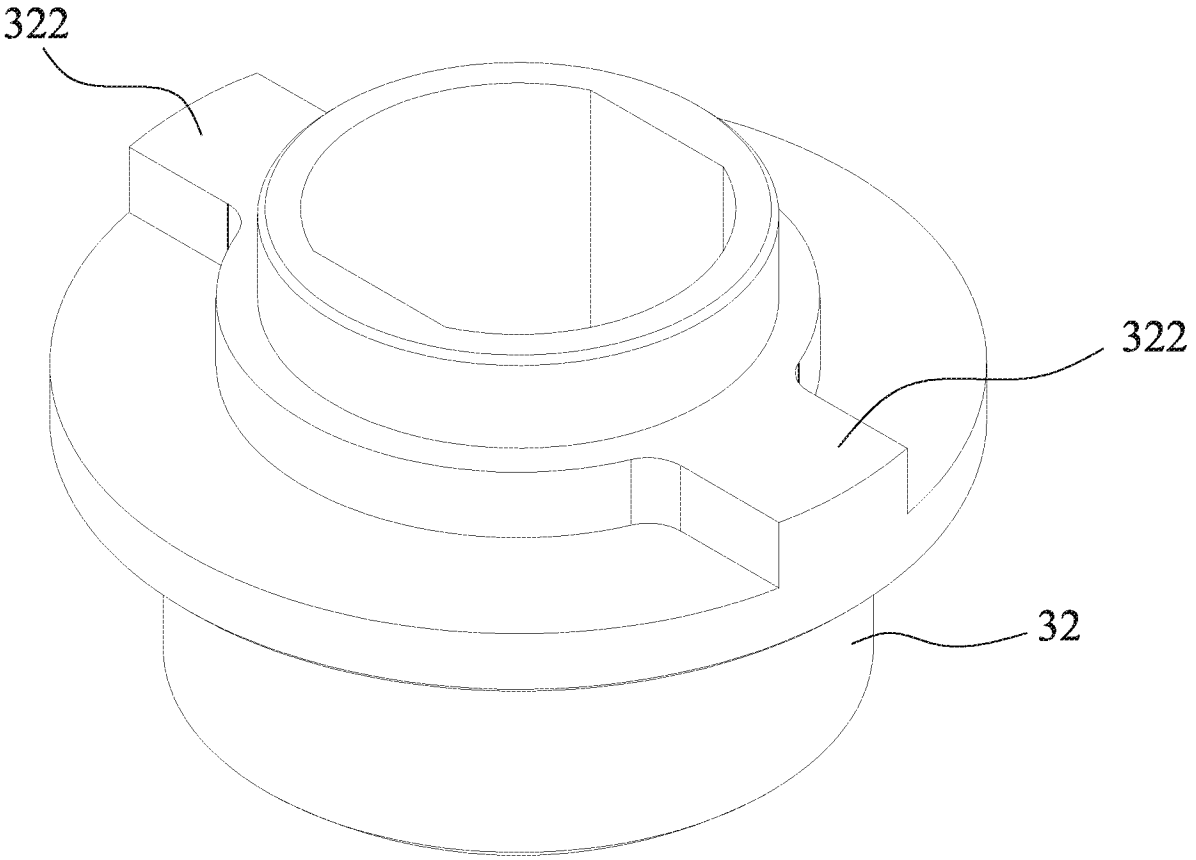
FIG. 6 is a perspective view of a first socket member of the first embodiment.
Figure 7:
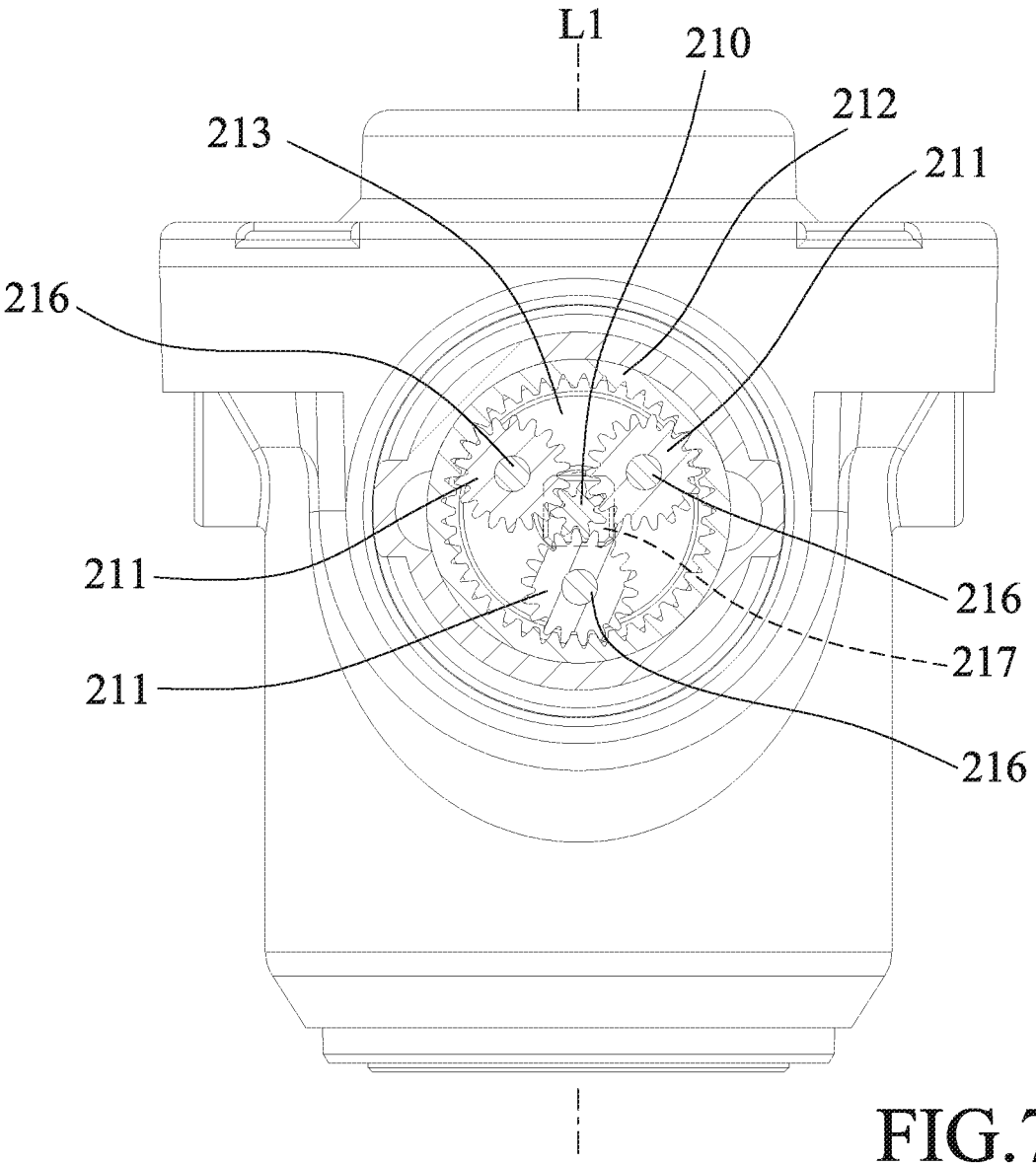
FIG. 7 is a front sectional view of the first embodiment taken along line VII-VII of FIG. 3.

The second socket member 33 is opposite to the first socket member 32 and is disposed at the other one of the two axially opposite ends of the output spindle 31. The second socket member 33 has a second socket hole 331 aligned with the first socket hole 321. The second socket hole 331 is also configured to engage a nut, screw, or the like. The tubular connection member 34 connects between the first and second socket members 32, 33 in communication with the first and second socket holes 321,331 and is disposed inside the axial through hole 311, for instance, in a frictionally fitting manner. In particular, the tubular connect ion member 34 is formed as one piece with the second socket member 33, and one end of the tubular connection member 34 opposite to the second socket member 33 is engagingly inserted into the first socket member 32 for concomitant rotation. As best shown in FIGS. 4 and 6, one end of the first socket member 32 has a non-circular hole and the inserted end of the tubular connection member 34 has a non-circular cross section. In this embodiment, while the second socket member 33 is unitarily formed with the tubular connection member 34 in this embodiment, the power wrench of the disclosure is not limited hereto.

The housing unit 4 covers the motor 1, the drive unit 2 and the output unit 3, and includes a first housing 41 and a second housing 42. The first housing 41 covers and accommodates the drive unit 2 and the output unit 3. In addition, the first housing 41 has two opposite housing openings 411 and a lateral hole 412. The two opposite housing openings 411 open outwards of the power wrench and are aligned with the first socket hole 321, the axial through hole 311 and the second socket hole 331 to provide a passage extending through the first socket hole 321 and the axial through hole 311 and between the opposite housing openings 411. The lateral hole 412 is disposed in one side of the first housing 41 between the opposite openings 411. The second housing 42 covers and accommodates the first housing 41 and the motor 1. The lateral hole 412 communicates with a receiving space of the second housing 42 for the motor 1.

During activation of the motor 1, the motor shaft 11 drives the sun gear 210 to rotate the planetary gears 211 with respect to the ring gear 212, thereby transmitting power to the carrier 213. The carrier 213 transmits the power to the first bevel gear 214 to concomitantly rotate with the second bevel gear 215. The second bevel gear 215 drives the output spindle 31. Rotation of the output spindle 31 is transmitted to the flywheel 23 through the engaging balls 35, and then to the first socket member 32 through the drive projections 231 of the flywheel 23 that engage the radial projections 322 of the first socket member 32. Frictional engagement between the output spindle 31 and the first socket member 32 also transmits motion from the output spindle 31 to the first socket member 32. As the first socket member 32 rotates, the second socket member 33 rotates concomitantly.

Figure 5:
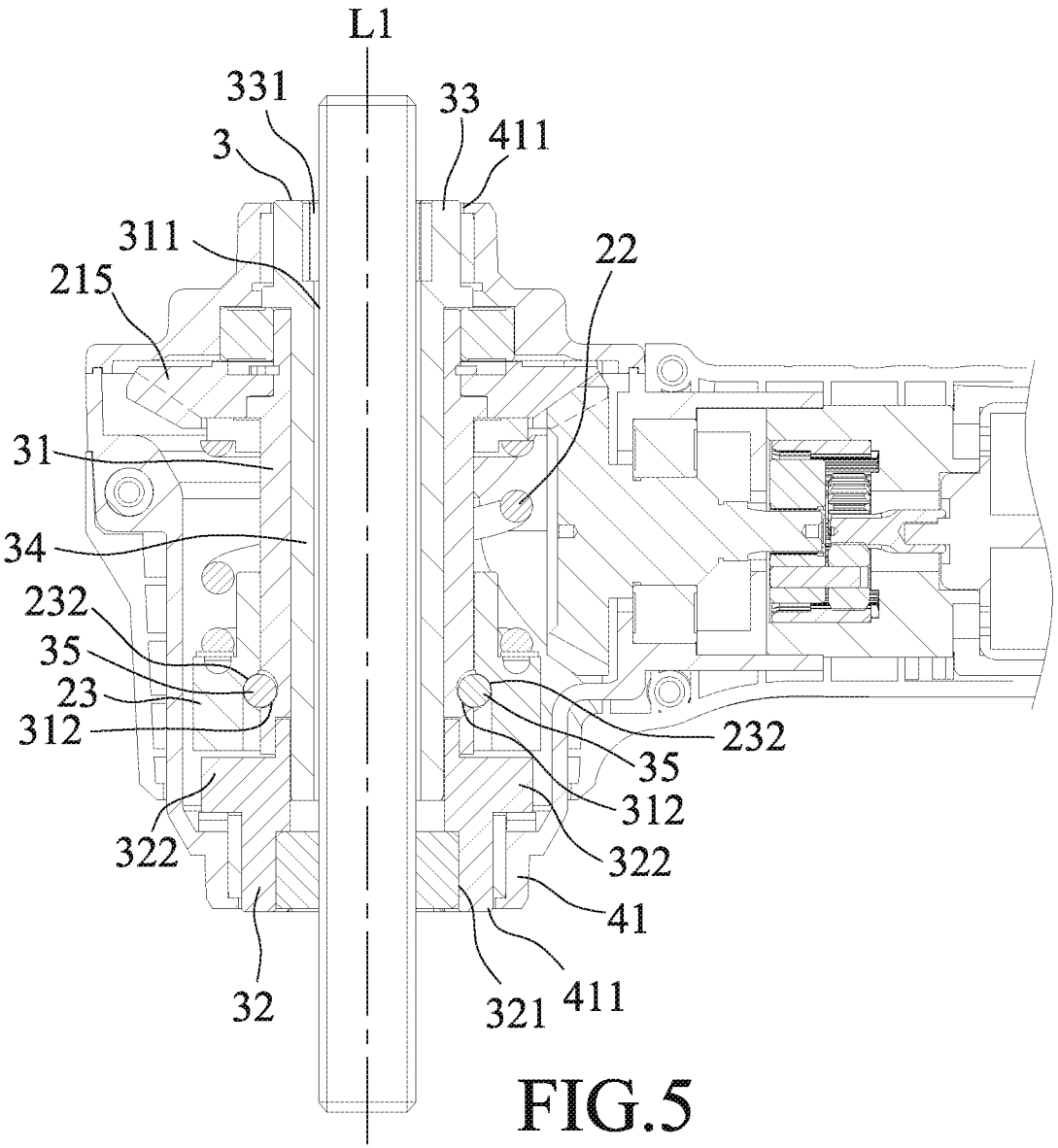
FIG. 5 is a fragmentary sectional view of the first embodiment.

The first socket hole 321 and the second socket hole 331 have different sizes and can engage differently sized nuts or screw heads. As shown in FIG. 5, the first socket member 32 is sleeved on a nut to rotate and tighten the nut around a bolt. Because the bolt is allowed to pass through the axial through hole 311, the operation of tightening the nut can be performed properly and smoothly even if the bolt is very long. Therefore, the power wrench of the disclosure is suitable for various bolt lengths, unlike the power wrench disclosed in U.S. Pat. No. 9,592,600, which is suitable only to bolts having limited lengths. Generally, a nut has an equilateral hexagonal shape and can be fitted into and driven by a square socket having a corresponding dimension. In this embodiment, each of the first and second socket holes 321, 331 has a shape formed by stacking two differently sized square holes in a coaxial manner and rotating them relative to each other until their corners are staggered. Therefore, each of the first and second socket holes 321, 331 is engageable with two differently sized nuts. In other words, the power wrench of the disclosure is usable for four differently sized nuts, thereby enhancing a convenience level and an application range of the power wrench of the disclosure.

When the nut is initially tightened, there is no relative movement between the nut and bolt, and the first and second socket members 32, 33 are at rest. However, because the motor 1 is still in operation, the output spindle 31 is able to rotate relative to the first socket member 32 as the friction between the output spindle 31 and the first socket member 32 is overcome. The flywheel 23 is rotatable along with the output spindle 31. During the rotation of the output spindle 31 and the flywheel 23 relative to the first socket member 32, the drive projections 231 of the flywheel 23 can jump off and disengage from the radial projections 322 of the first socket member 32 at rest by compressing the spring 22 and can re-engage and strike the radial projections 322 by the returning force of the spring 22. Continued rotation of the flywheel 23 results in repeated disengaging and re-engaging actions of the drive projections 231 which deliver intermittent impact blows to the first socket member 32 until the nut is fully tightened. As such, the motor can be prevented from damages due to overloading.

Figure 8:
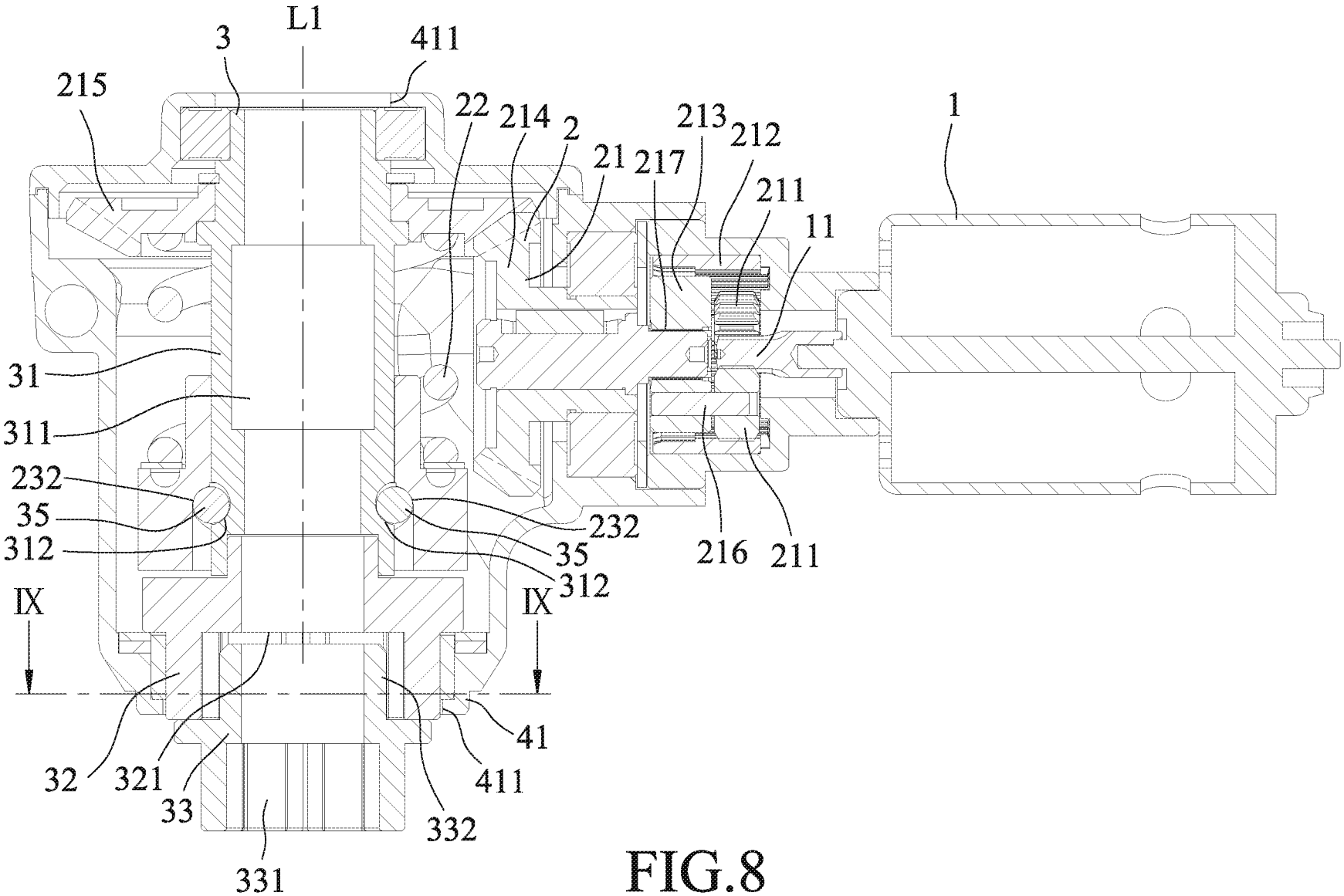
FIG. 8 is a sectional view illustrating a second embodiment of a power wrench according to the disclosure.
Figure 9:
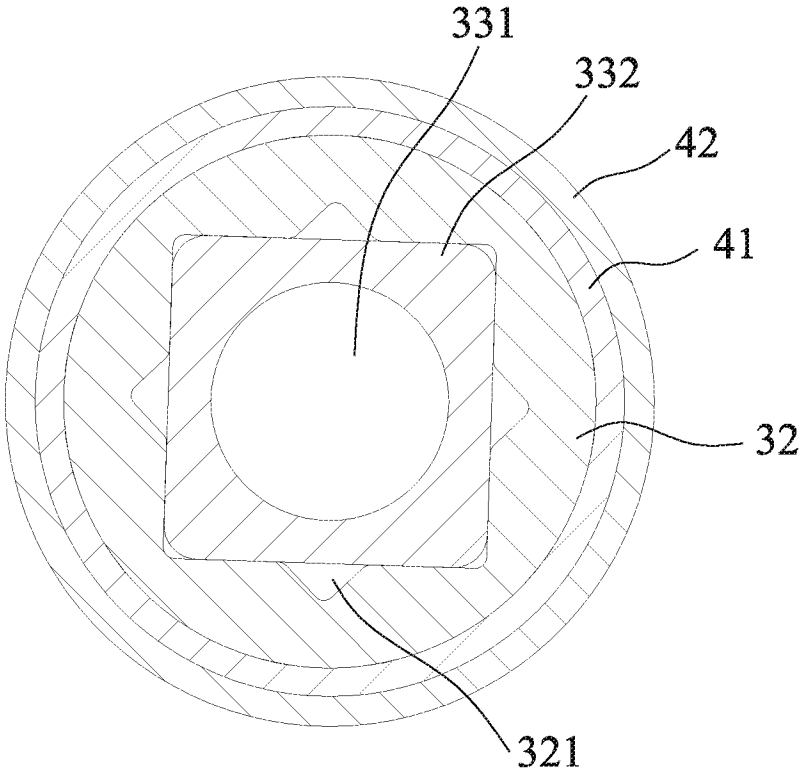
FIG. 9 is a sectional view of the second embodiment taken along line IX-IX of FIG. 8.

FIGS. 8 and 9 illustrate a second embodiment of a power wrench according to the disclosure, which has a structure generally similar to that of the first embodiment. However, in this embodiment, the tubular connection member 34 is omitted, and the second socket member 33 is removably connected to the first socket member 32.

The second socket member 33 further has an engagement portion 332 removably engaging the first socket hole 321 of the first socket member 32. The second socket hole 331 of the second socket member 33 is alignedly communicated with the first socket hole 321 of the first socket member 32 and the axial through hole 311.

Because the engagement portion 332 removably engages the first socket hole 321, a plurality of the second socket members 33 with varying sizes may be interchangeably connected to the first socket member 32 to operate differently sized nuts. This arrangement provides more convenience to the user.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A power wrench comprising:

a motor having a motor shaft;

a drive unit connected to said motor and including a gear set driven by said motor shaft;

an output unit connected to said gear set, and including an output spindle that is driven by said gear set and that is rotatable about a rotation axis transverse to said motor shaft, said output spindle having an axial through hole that extends through said output spindle and that opens at two axially opposite ends of said output spindle, said axial through hole being configured to permit passage of a bolt, and a first socket member directly connected to said output spindle at one of said two axially opposite ends, said first socket member having a first socket hole aligned with said axial through hole and configured to engage a nut, a screw head, or the like;

a housing unit covering said motor, said drive unit and said output unit, and having two opposite housing openings which open outwards of said power wrench and each of which aligned with said first socket hole and said axial through hole to provide a passage extending through said first socket hole and said axial through hole and between said opposite housing openings;

wherein said drive unit further includes a spring and a flywheel sleeved on said output spindle and urged by said spring to move toward said first socket member, said flywheel being rotatable along with said output spindle and having a plurality of drive projections projecting toward said first socket member; and wherein said first socket member further has a plurality of radial projections engageable with said drive projections.

2. The power wrench as claimed in claim 1, wherein said output unit further includes a second socket member opposite to said first socket member and disposed at the other one of said two axially opposite ends of said output spindle, said second socket member having a second socket hole aligned with said first socket hole and said axial through hole and configured to engage a nut, screw head or the like.

3. The power wrench as claimed in claim 2, wherein said output unit further includes a tubular connection member that connects between said first and second socket members in communication with said first and second socket holes and that is disposed inside said axial through hole.

4. The power wrench as claimed in claim 1, wherein said output unit further includes a second socket member having an engagement portion removably engaging said first socket hole, and a second socket hole configured to engage a nut, a screw head, or the like, said second socket hole being communicated with said axial through hole.

5. The power wrench as claimed in claim 1, wherein said gear set has a sun gear mounted to said motor shaft, a carrier, a plurality of planetary gears meshed with said sun gear and mounted to said carrier, a ring gear surrounding and meshed with said planetary gears, a first bevel gear connected to said carrier, and a second bevel gear meshed with said first bevel gear, said ring gear being positioned to said housing unit, said carrier being concomitantly rotatable with said planetary gears, said first bevel gear being concomitantly rotatable with said carrier.

6. The power wrench as claimed in claim 5, wherein said second bevel gear is hollow and is sleeved on said output spindle for concomitant rotation.

7. The power wrench as claimed in claim 5, wherein said spring is connected between said second bevel gear and said flywheel.

8. A power wrench comprising:

a motor having a motor shaft;

a drive unit connected to said motor and including a gear set driven by said motor shaft;

an output unit connected to said gear set, and including an output spindle that is driven by said gear set and that is rotatable about a rotation axis transverse to said motor shaft, said output spindle having an axial through hole that extends through said output spindle and that opens at two axially opposite ends of said output spindle, said axial through hole being configured to permit passage of a bolt, and a first socket member connected to said output spindle at one of said two axially opposite ends, said first socket member having a first socket hole aligned with said axial through hole and configured to engage a nut, a screw head, or the like;

a housing unit covering said motor, said drive unit and said output unit, and having two opposite housing openings which open outwards of said power wrench and each of which aligned with said first socket hole and said axial through hole to provide a passage extending through said first socket hole and said axial through hole and between said opposite housing openings;

wherein said drive unit further includes a flywheel that is sleeved on and rotatable along with said output spindle and that is urged by a spring toward said first socket member, said flywheel having a plurality of drive projections projecting toward said first socket member;

wherein said first socket member has a first end portion inserted into said axial through hole, a second end portion disposed distally from said axial through hole, and an intermediate portion disposed between said first and second end portions; and wherein said first socket member further has a plurality of radial projections which are engageable with said drive projections of said flywheel and which protrude radially from said intermediate portion.

9. The power wrench as claimed in claim 8, wherein said first socket member further has an annular flange protruding radially from said intermediate portion between said second end portion and said radial projections and having a flange surface facing said radial projections, said radial projections lying on said flange surface.

* * * * *